US007262358B2

(12) United States Patent
Lubbers

(10) Patent No.: US 7,262,358 B2
(45) Date of Patent: Aug. 28, 2007

(54) PORTABLE VOICE STUDIO SYSTEM AND METHOD

(75) Inventor: David L. Lubbers, Knob Lick, MO (US)

(73) Assignee: Supply Unlimited, Inc., Knob Lick, MO (US)

( * ) Notice: Subject to any disclaimer, the term of this patent is extended or adjusted under 35 U.S.C. 154(b) by 0 days.

(21) Appl. No.: 10/700,116

(22) Filed: Nov. 3, 2003

(65) Prior Publication Data

US 2005/0092162 A1 May 5, 2005

(51) Int. Cl.
*G10H 1/08* (2006.01)
*G10H 7/00* (2006.01)

(52) U.S. Cl. ..... 84/625; 381/119

(58) Field of Classification Search ..... 434/307 A; 381/119, 74, 118, 122; 84/625
See application file for complete search history.

(56) References Cited

U.S. PATENT DOCUMENTS 4,412,106 A * 10/1983 Pavel ..... 381/309
5,286,912 A 2/1994 Yamaguchi
5,383,079 A 1/1995 Takao
5,465,240 A 11/1995 Mankovitz
5,563,358 A 10/1996 Zimmerman
5,606,143 A 2/1997 Young
5,609,487 A 3/1997 Setlabudi et al.
5,633,473 A 5/1997 Mori et al.
5,789,689 A 8/1998 Doidic et al.
5,820,384 A * 10/1998 Tubman et al. ..... 434/308
5,822,440 A 10/1998 Oltman et al.
5,951,302 A 9/1999 Decker, Jr.
5,982,904 A * 11/1999 Eghtesadi et al. ..... 381/74
6,025,553 A 2/2000 Lee
6,114,774 A 9/2000 Fiegura
6,267,600 B1 7/2001 Song
6,278,048 B1 * 8/2001 Lee ..... 84/610
6,328,570 B1 * 12/2001 Ng ..... 434/307 A
6,350,943 B1 2/2002 Suruga et al.
6,407,325 B2 * 6/2002 Yi et al. ..... 84/610
6,737,570 B2 * 5/2004 Stevenson ..... 84/610
2002/0132212 A1 9/2002 Hou
2002/0176586 A1 * 11/2002 Leonard ..... 381/75
2002/0189429 A1 * 12/2002 Qian et al. ..... 84/610
2004/0208328 A1 * 10/2004 Strother ..... 381/119

FOREIGN PATENT DOCUMENTS

JP WO0152236 A1 7/2001
JP WO0175859 A1 10/2001

* cited by examiner

*Primary Examiner*—Jeffrey W Donels
(74) *Attorney, Agent, or Firm*—Armstrong Teasdale LLP

(57) ABSTRACT

A portable voice studio apparatus is provided. The apparatus includes a microphone, a music generation device, a processing unit, and a headphone. The processing unit is contained in a single housing. The processing unit is electrically coupled with the microphone and the music generation device for receiving a first input signal from the microphone and a second input signal from the music generation device. The processing unit is configured to amplify and add an intended effect to at least one of the first and second input signals to generate an output signal. The headphone receives the output signal from the processing unit to enable a user to hear the output.

24 Claims, 2 Drawing Sheets

PORTABLE VOICE STUDIO SYSTEM AND METHOD

BACKGROUND OF THE INVENTION

This invention relates generally to a portable voice studio system, and more particularly, to a system and method for controlling the electronic reproduction of a human voice.

In the music industry, recording studios are used to adjust, amplify, enhance, control and otherwise affect either the audio portion of a multimedia event or a production, which is solely audio, such as a song or composition. Recording studios perform audio "tasks" (such as equalization, reverberation, etc.) and edit a digital waveform to produce an interesting effect. Because of the processing capability of the recording studio, a digital waveform can be easily modified prior to playing back the signal and new sounds can be generated that are variations on the original audio. Alternatively, the signal can be enhanced or improved by digital processing techniques to eliminate imperfections in the original sound. While high quality musical recordings can be produced by mixing sound from different sources in a professional sound recording studio, access to such studios is often limited and the cost of renting a recording studio is extremely high. This limits the opportunities of a singer to practice while be able to utilize the processing capabilities of a recording studio.

Moreover, during a live performance, the audio signals produced by the performers, for example through singing or playing a musical instrument, are typically controlled by a sound board. The sound board receives the audio signals produced by the performers, processes the signals, and generates a signal output. The signal output is transmitted to several audio speakers that produce a sound from the signal output. The sound is the music being generated by the performers. Typically, these speakers are positioned in close proximity to the performers and direct the musical sound toward the performers such that the performers are able to hear what the audience is also hearing. The sound board and stage speaker arrangement does not allow an individual performer to control the sound level of his or her performance, nor does it allow an individual performer to control the sound level of the other performers on stage. Consequently, a performer may experience difficulties hearing themselves sing or play a musical instrument because of the sound level of the other performers. In addition, a performer is not able to adjust or control the sound of his or her performance independently from the sound board in a convenient and portable manner.

BRIEF DESCRIPTION OF THE INVENTION

In one aspect, an apparatus is provided. The apparatus includes a microphone, a music generation device, a processing unit, and a headphone. The processing unit is contained in a single housing. The processing unit is electrically coupled with the microphone and the music generation device for receiving a first input signal from the microphone and a second input signal from the music generation device. The processing unit is configured to amplify and add an intended effect to at least one of the first and second input signals to generate an output signal. The headphone receives the output signal from the processing unit to enable a user to hear the output.

In another aspect, a method for mixing and controlling sound is provided. The method includes transmitting a first input signal from a microphone to a processing unit, communicating a second input signal from a portable music generating device to the processing unit, and processing at the processing unit the at least one of the first and second input signals to add an intended effect for generating an output signal.

In a further aspect, a sound system is provided. The sound system includes a sound board for receiving, processing, and transmitting sound, and a portable studio system. The portable studio system includes a microphone, a music generation device, a processing unit, and a headphone. The microphone is configured to transmit a first input signal from a user's voice. The music generation device is configured to communicate a second input signal. The processing unit is contained in a single housing and is electrically coupled with the microphone and the music generation device for receiving the first and second input signals. The processing unit is configured to amplify and add an intended effect to at least one of the first and second input signals to generate an output signal. The headphone is configured to enable the user to receive the output signal.

DETAILED DESCRIPTION OF THE INVENTION

Figure 1:
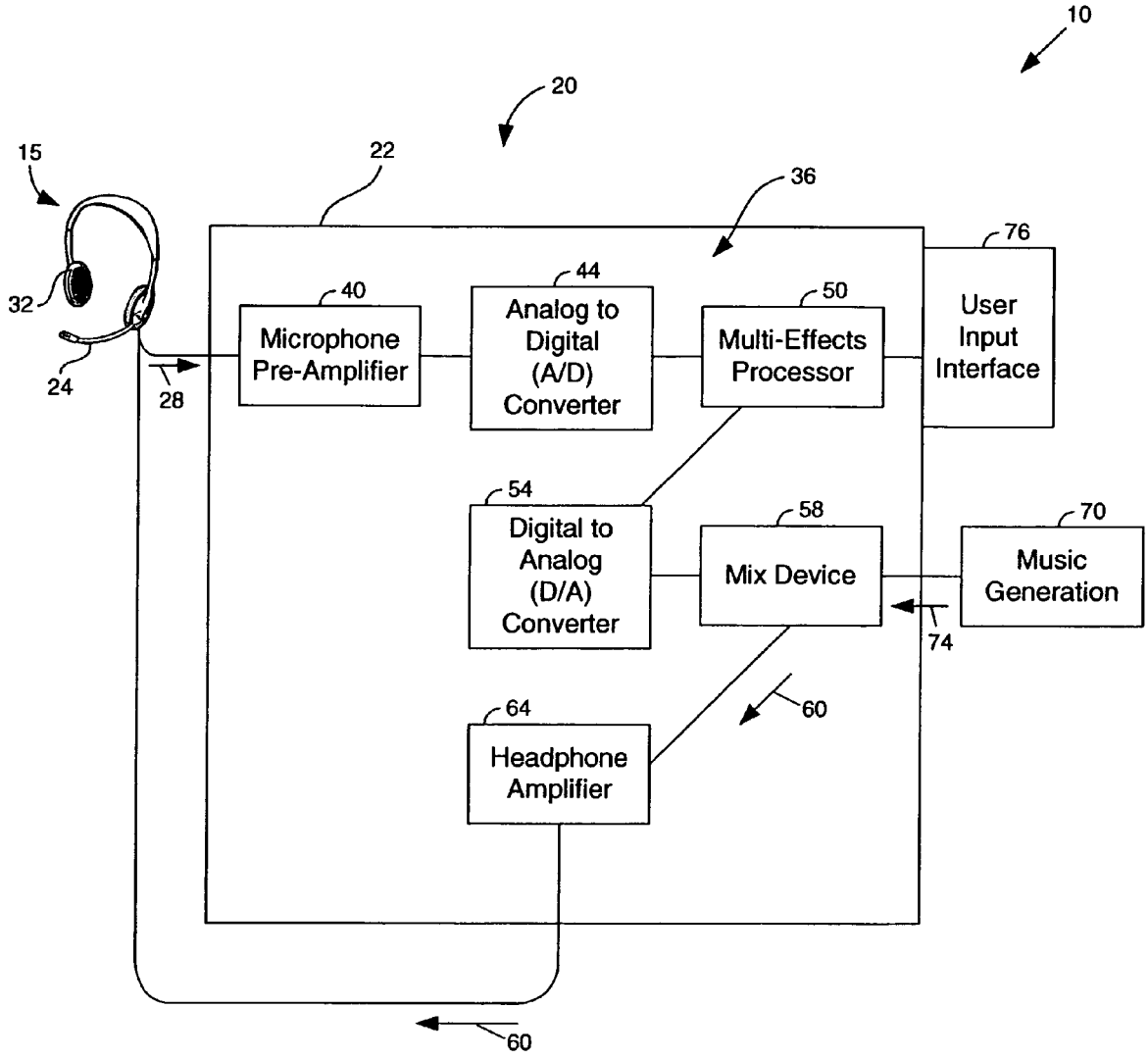
FIG. 1 is a schematic illustration of a portable voice studio system according to an embodiment of the present invention.

FIG. 1 is a schematic illustration of a portable voice studio system 10. Portable voice studio system 10 includes a headset 15 in communication with a processing unit 20. Processing unit 20 is contained within a single housing 22. In one embodiment, headset 15 includes a microphone 24, such as a condensor microphone, configured to transmit a first input audio signal, as indicated by arrow 28, from a user's voice and at least one headphone 32 configured to receive an audio output. In one embodiment, headphone 32 is enhanced with a titanium driver. In another embodiment, microphone 24 is coupled to headphone 32 providing improved mobility and convenience.

Processing unit 20 includes a sound mixer 36 contained therein. Sound mixer 36 is in communication with microphone 24. Sound mixer 36 includes a microphone pre-amplifier 40 which is in communication with microphone 24. In one embodiment, microphone pre-amplifier 40 includes a power source to power microphone 24. Microphone pre-amp 40 is configured to amplify first input signal 28 received from microphone 24. Sound mixer 36 also includes an A/D (analog-to-digital) converter 44, such as a 24-bit or 16-bit A/D converter. A/D converter 44 receives first input signal 28 from microphone pre-amplifier 40 and converts first input signal 28 to a digital signal.

Sound mixer 36 further includes a multi-effects processor 50, such as a 24-bit or a 16-bit multi-effects processor. Multi-effects processor 50 receives the digitized audio signal from A/D converter 44, and then processes the digitized audio signal by adding various effects including, but not limited to, echo, modulation, and ambience. In one embodiment, multi-effects processor 50 is connected to a DRAM (dynamic random access memory) which temporarily stores the digital signal that has been processed.

Sound mixer 36 further includes a D/A (digital-to-analog) converter 54. D/A converter 54 receives the digital signal from multi-effects processor 50 and converts the digital signal to an analog audio signal. D/A converter 54 is also in communication with a mix device 58. Mix device 58 receives the analog audio signal from D/A converter 54 and generates an output signal, as indicated by arrow 60. Mix device 58 is in communication with a headphone amplifier 64. Mix device 58 communicates output signal 60 to headphone amplifier 64. Headphone amplifier 64 then communicates output signal 60 to headphone 32. Headphone 32 is configured to receive output signal 60 from sound mixer 36. Processing unit 20 is configured to amplify and add an intended effect to first input signal 28 to generate output signal 60.

In one embodiment, sound mixer 36 is in communication with a portable music generation device 70. Music generation device 70 is configured to communicate a second input signal, as indicated by arrow 74, to mix device 58. Second input signal 74 can be generated from, a plurality of devices including but is not limited to, a wireless receiver, an audio player, a digital player, such as a compact disc player (CD player), or a player capable of playing media in a known MP3 format (MP3 player), a guitar processor, a keyboard, a live mixer output, and other audio sources. Portable music generation device 70 allows the user to practice his or her vocals with a live instrument as well as pre-recorded music. Thus, processing unit 20 is configured to amplify and add an intended effect to at least one of the first and second input signals to generate an output signal 60. Sound mixer 36 is configured to receive at least one of first and second input signals 28 and 74 and digitally alter at least one of first and second input signals 28 and 74 in order to generate output signal 60 based on at least one of first and second input signals 28 and 74, respectively. In one embodiment, music generation device 70 is external to processing unit 20. In another embodiment, music generation device 70 is internal to processing unit 20.

In an alternative embodiment, at least one secondary microphone (not shown) may be coupled to sound mixer 36 to transmit another voice input signal into sound mixer 36. At least one secondary microphone allows at least two vocalists to sing and rehearse together using portable voice studio system 10.

In another embodiment, a recording device (not shown) is in communication with sound mixer 36. Recording device is configured to receive output signal 60 generated by sound mixer 36 and record output signal 60 on a recording medium. In addition, the recorded performance can then be transmitted back to sound mixer 36 so a vocalist can sing harmony over his or her own previous performance and digitally alter at least one of his or her own voice input and previous performance.

In one embodiment, a user input interface 76 is electronically coupled to sound mixer 36. In the exemplary embodiment, user input interface 76 includes at least one of a control panel, a liquid crystal display (LCD), and a keypad. User input interface 76 enables a user to control the altered effects of sound mixer 36. Different presets are provided on user input interface 76 such that the user can alter the size of the listening environment, the tone quality, and other effects by selecting at least one of the presets or altering the effects of sound mixer 36.

Figure 2:
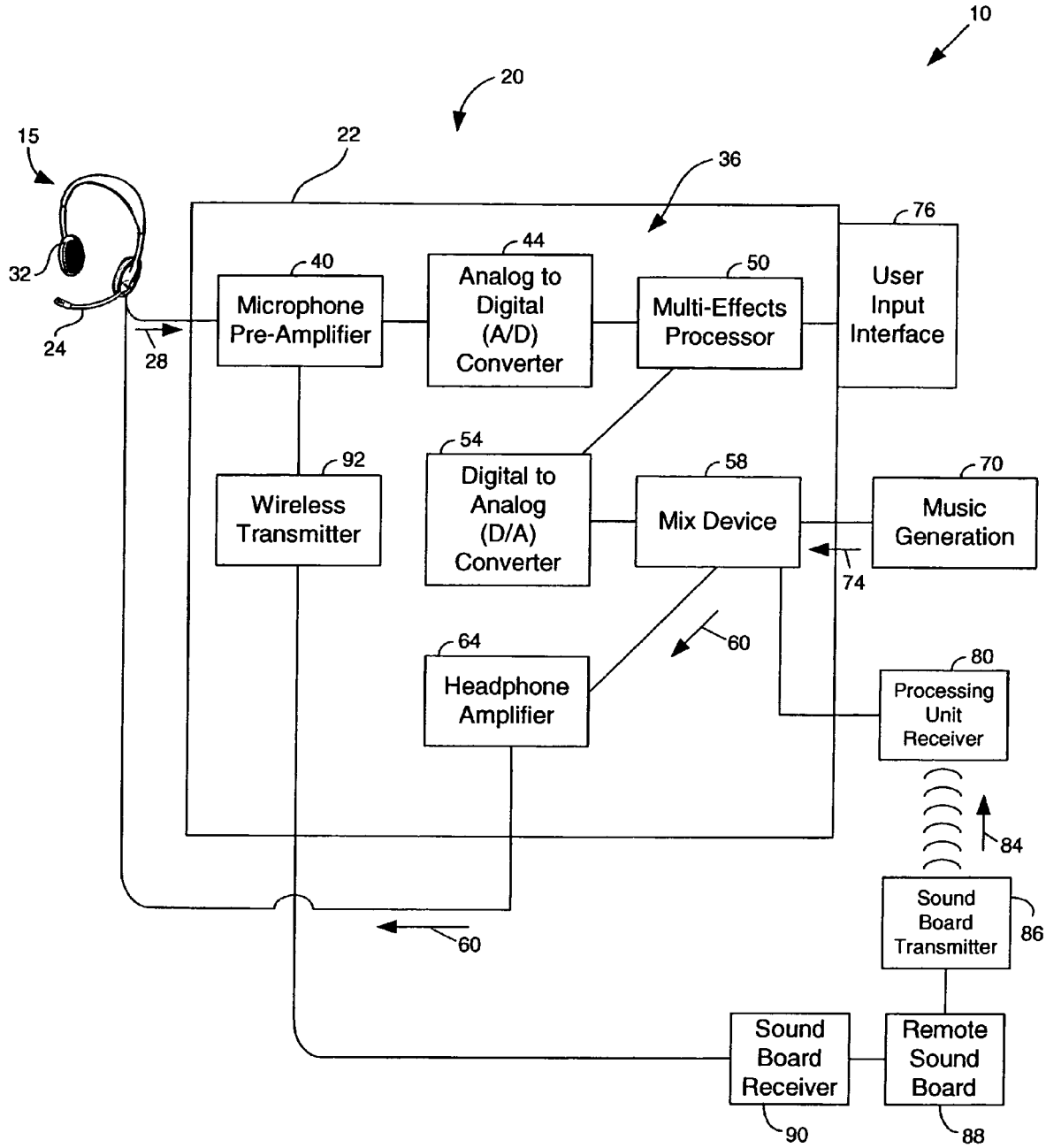
FIG. 2 is a schematic illustration of a portable voice studio system according to another embodiment of the present invention.

FIG. 2 is a schematic illustration of another embodiment of portable voice studio system 10. Components in portable voice studio system 10 that are identical to components in portable voice studio system 10 described above with regard to FIG. 1 are identified in FIG. 2 using the same reference numerals used in FIG. 1. An input signal receiver 80 is electrically coupled to processing unit 20. Processing unit receiver 80 receives a wireless transmission or a third input signal as indicated by arrow 84 through a wireless transmitter 86 that is in communication with a remote sound board 88. Processing unit 20 is configured to alter at least one of first, second, and third inputs 28, 74 and 84 to generate output signal 60 based on at least one first, second, and third input signals 28, 74 and 84. In the example embodiment, if a user is receiving third input signal 84 from sound board 88, processing unit 20 is configured to enable a user to alter third input signal 84, if so desired, to generate output signal 60.

In the example embodiment, processing unit receiver 80 is in communication with mix device 58. Third input signal 84 is transmitted from sound board 88 using wireless transmitter 86. Sound board 88 is configured to receive at least one input signal through a receiver 90 that is in communication with sound board 88. Sound board 88 processes the at least one received input signal before transmitting a processed signal to processing unit receiver 80. In the example embodiment, first input signal 28 is received at microphone pre-amplifier 40. Microphone pre-amplifier 40 is configured to direct first input signal 28 to either a wireless transmitter 92 or A/D converter 44. Wireless transmitter 92 is included within processing unit 20.

If input signal 28 is directed to wireless transmitter 92, input signal 28 is then transmitted by wireless transmitter 92 to sound board receiver 90. Input signal 28 is then processed at sound board 88, and then transmitted as third input signal 84 to processing unit receiver 80 using sound board transmitter 86. Signal 84 is received and can be further processed at mix device 58 to generated signal 60. Mix device 58 communicates signal 60 to headphone amplifier 64. Headphone amplifier 64 then communicates output signal 60 to headphone 32. Headphone 32 is configured to receive output signal 60. Processing unit 20 is configured to amplify and add an intended effect to first input signal 28 to generate output signal 60.

In another embodiment, remote sound board 88 is configured to process or mix input signal 28 with other signals received at sound board 88 to produce a mixed third input signal 84. For example, sound board 88 may receive signal 28 from microphone 24, and may receive another input signal from a musical instrument. Both the voice signal and instrument signal may be processed or mixed at remote sound board 88 before transmitting a mixed signal back to processing unit 20. Of course, this example is for illustration purposes. The example embodiment may include any number of signals received, processed, and mixed at sound board 88 before an output signal including at least one of the input signals or any combination of the input signals is transmitted from sound board 88 back to processing unit 20.

In the example embodiment, wireless transmitter 92 and wireless transmitter 86 operate on different frequencies.

During a performance, a performer who utilizes portable voice studio system 10 will provide first input signal 28. First input signal 28 is transmitted to sound board 88. Input signals (not shown) from other performers are also transmitted to sound board 88. Sound board 88 then processes signal 28 along with the other signals received before transmitting the processed signal back to processing unit 20. Processing unit 20 then enables a user to further process the signal received from sound board 88 such that the performer can listen to his or her performance by isolating his or her own voice or instrument from the other performers.

In another embodiment, the performer can digitally alter at least one of first, second, and third input signals 28, 74 and 84 independently of sound board 88 and listen to his or her own generated output signal.

Portable voice studio system 10 allows a person to control the effects of his or her own voice as well as control other audio sources to better hear and control their own performance independent from the sound board and other band members. For example, if the performer wants to hear only his or her voice without hearing the other vocals or instruments, the performer can control the volume from the other audio sources to isolate his or her own voice. In this way, the performer can then digitally alter his or her own voice and add effects independent from the sound board or the band. Portable voice studio system 10 may be, for example, coupled to a belt of a user while the user wears headset 15 on his or her head allowing the user to walk around with portable voice studio system 10.

While the invention has been described in terms of various specific embodiments, those skilled in the art will recognize that the invention can be practiced with modification within the spirit and scope of the claims.

What is claimed is:

1. An apparatus comprising:

a headset comprising a microphone and a headphone;

a music generation device;

a processing unit contained in a single housing, said processing unit electrically coupled with said headset and said music generation device for receiving a first input signal from said microphone and a second input signal from said music generation device, said processing unit comprising a transmitter for transmitting said first input signal to a remote receiver to be processed and an input to couple to a receiver for receiving a processed signal from the remote receiver, said processing unit configured to amplify and add an intended effect to at least one of the first input signal, the second input signal, and the processed signal to generate an output signal, wherein the output signal is transmitted to said headphone to enable a user to hear the output; and a user input interface coupled to said housing of said processing unit, said user interface configured to control the output signal of said processing unit by at least one of altering the amplification of the processed signal and at least one of the first input signal and the second input signal and removing at least one of the first input signal, the second input signal, and the processed signal from the output signal.

2. The apparatus according to claim 1, wherein said apparatus is sized to be portable such that a single user can transport said apparatus while utilizing said apparatus.

3. The portable apparatus according to claim 1, wherein said processing unit further comprises at least one of a microphone pre-amplifier, an analog-to-digital converter, a multi-effects processor, a digital-to-analog converter, a mix device, and a headphone amplifier.

4. The portable apparatus according to claim 1, wherein said microphone and said headphone are coupled to one another such that a relative position of said microphone is configured to be fixed with respect to said headphones.

5. The portable apparatus according to claim 1 wherein said music generation device is at least one of an analog player, a digital player, and a musical instrument.

6. A portable apparatus according to claim 1 further comprising a second microphone electrically coupled to said processing unit, said secondary microphone configured to communicate a third input signal to said processing unit.

7. A method for mixing and controlling sound, said method comprising:

transmitting a first input signal from a headset to a processing unit;

communicating a second input signal from a portable music generating device to the processing unit;

transmitting the first input signal from the processing unit to a remote receiver to be processed;

receiving at the processing unit a processed signal from the remote receiver;

processing at the processing unit at least one of the first input signal, the second input signal, and the processed signal for generating an output signal;

controlling the output signal of said processing unit by at least one of altering the amplification of the processed signal and at least one of the first input signal and the second input signal and removing at least one of the first input signal, the second input signal, and the processed signal from the output signal; and transmitting the output signal to the headset.

8. The method according to claim 7 wherein transmitting a first input signal further comprises transmitting a first input signal from the headset to a portable processing unit contained in a single housing such that a single user can transport the processing unit while utilizing the processing unit.

9. The method according to claim 7 further comprising recording the output signal with a portable recording device.

10. The method according to claim 7 wherein providing a second input signal from a portable music generating device further comprises providing a second input signal from at least one of an analog player, a digital player, and a musical instrument.

11. A sound system comprising:

a sound board for receiving, processing, and transmitting sound; and a portable studio system configured to communicate with said sound board, said portable studio system comprising:

a headset comprising a headphone and a microphone configured to transmit a first input signal from a user's voice;

a music generation device configured to communicate a second input signal;

a processing unit contained in a single housing, said processing unit electrically coupled with said headset and said music generation device for receiving said first and second input signals, said processing unit comprising a transmitter for transmitting said first input signal to said sound board to be processed and an input to couple to a receiver for receiving a processed signal from the sound board, said processing unit configured to amplify and add an intended effect to at least one of the first input signal, the second input signal, and the processed signal to generate an output signal, wherein the output signal is transmitted to said headphone; and a user input interface coupled to said housing of said processing unit, said user interface configured to control the output signal of said processing unit by at least one of altering the amplification of the processed signal and at least one of the first input signal and the second input signal and removing at least one of the first input signal, the second input signal, and the processed signal from the output signal.

12. The sound system according to claim 11, wherein said processing unit further comprises at least one of a microphone pre-amplifier, an analog to digital converter, a multi-effects processor, a digital to analog converter, a mix device, and a headphone amplifier.

13. The sound system according to claim 11, wherein said microphone and said headphone are coupled to one another such that a relative position of said microphone is configured to be fixed with respect to said headphones.

14. The sound system according to claim 11 wherein said music generation device is at least one of an analog player, a digital player, and a musical instrument.

15. The sound system according to claim 11 further comprising a recording device in communication with said processing unit for recording at least one of said first and second input signals.

16. The sound system according to claim 11 wherein said sound board further comprises an input signal receiver for receiving a third input signal from a remote audio source, said processing unit configured to amplify and add an intended effect to at least one of said first, second, and third input signals to generate an output signal based on at least one of said first, second, and third input signals.

17. The sound system according to claim 16 wherein said third input signal includes at least one of a voice input signal different from said first input signal, a musical instrument, and a sound effect.

18. An apparatus according to claim 1 wherein said transmitter is configured to wirelessly transmit said first input signal to said remote receiver and said receiver is configured to wirelessly receive said processed signal from said remote receiver.

19. A method according to claim 7 wherein said transmitting the first input signal from the processing unit to a remote receiver comprises wirelessly transmitting the first input signal from the processing unit to a remote receiver.

20. A method according to claim 7 wherein said receiving at the processing unit a processed signal from the remote receiver comprises wirelessly receiving at the processing unit a processed signal from the remote receiver.

21. A sound system according to claim 11 wherein said transmitter is configured to wirelessly transmit said first input signal to said sound board.

22. A sound system according to claim 11 where said receiver is configured to wirelessly receive said processed signal from said sound board.

23. A portable apparatus according to claim 3 wherein said microphone pre-amplifier is configured to power at least one component of said portable apparatus.

24. A portable apparatus according to claim 3 wherein said microphone pre-amplifier is configured to power said portable apparatus.

* * * * *